US007642698B2

(12) United States Patent
Leija et al.

(10) Patent No.: US 7,642,698 B2
(45) Date of Patent: Jan. 5, 2010

(54) DUAL DIRECTION RAKE PIEZO ACTUATOR

(75) Inventors: Javier Leija, Chandler, AZ (US); Ioan Sauciuc, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 116 days.

(21) Appl. No.: 11/731,749

(22) Filed: Mar. 30, 2007

(65) Prior Publication Data

US 2008/0238256 A1 Oct. 2, 2008

(51) Int. Cl.
*H01L 41/04* (2006.01)
*H01L 41/08* (2006.01)

(52) U.S. Cl. ..... 310/328; 310/330; 310/331; 310/332

(58) Field of Classification Search ..... 310/330–332, 310/311, 328
See application file for complete search history.

(56) References Cited

U.S. PATENT DOCUMENTS 4,595,338 A * 6/1986 Kolm et al. ..... 416/81
4,834,619 A * 5/1989 Walton ..... 417/53
5,008,582 A * 4/1991 Tanuma et al. ..... 310/332
6,646,874 B2 * 11/2003 Pokharna et al. ..... 361/687
6,751,807 B2 * 6/2004 Klotz et al. ..... 2/171.3
7,031,155 B2 * 4/2006 Sauciuc et al. ..... 361/695
7,251,139 B2 * 7/2007 Bhattacharya et al. ..... 361/719
7,321,184 B2 * 1/2008 Lee et al. ..... 310/341
2004/0187501 A1 * 9/2004 Sauciuc et al. ..... 62/3.7
2007/0001550 A1 1/2007 Palanduz et al.
2007/0119575 A1 * 5/2007 Glezer et al. ..... 165/104.33
2007/0147046 A1 * 6/2007 Arik et al. ..... 362/294
2008/0217764 A1 * 9/2008 Campini et al. ..... 257/721

OTHER PUBLICATIONS

Acikahin, T., Piezoelectric actuators for low-form-factor electronics cooling , ASME/Pacific Rim Technical Conference and Exhibition on Integration and Packaging of MEMS, NEMS, and Electronic Systems: Advances in Electronic Packaging 2005, American Society of Mechanical Engineers , Publishing date:Dec. 1, 2005.*

Lee, Seri et al., "Cooling Device, System Containing Same, and Cooling Method", assigned U.S. Appl. No. 11/714,333, filed Mar. 6, 2007.

* cited by examiner

*Primary Examiner*—J. SanMartin
(74) *Attorney, Agent, or Firm*—Caven & Aghevli LLC

(57) ABSTRACT

Methods and apparatus relating to use and/or provision of a rake piezo actuator are described. In one embodiment, a piezo patch may be coupled to a plurality of blades (e.g., to cause the blades to oscillate and provide air flow between fins of one or more heat sinks). Other embodiments are also described.

17 Claims, 4 Drawing Sheets

DUAL DIRECTION RAKE PIEZO ACTUATOR

BACKGROUND

The present disclosure generally relates to the field of electronics. More particularly, an embodiment of the invention relates to dual direction rake piezo actuator.

Integrated circuit (IC) devices may generate heat during operation. Excessive heat may cause damage to IC devices. To cool IC devices, some implementations may use axial fans. Such fans may, however, increase manufacturing costs, increase power consumption, increase overhead (hardware and software) associated with fan speed control, reduce the available footprint in a computer for other components (e.g., due to the size of axial fans), increase noise, etc.

BRIEF DESCRIPTION OF THE DRAWINGS

The detailed description is provided with reference to the accompanying figures. In the figures, the left-most digit(s) of a reference number identifies the figure in which the reference number first appears. The use of the same reference numbers in different figures indicates similar or identical items.

DETAILED DESCRIPTION

In the following description, numerous specific details are set forth in order to provide a thorough understanding of various embodiments. However, various embodiments of the invention may be practiced without the specific details. In other instances, well-known methods, procedures, components, and circuits have not been described in detail so as not to obscure the particular embodiments of the invention. Further, various aspects of embodiments of the invention may be performed using various means, such as integrated semiconductor circuits ("hardware"), computer-readable instructions organized into one or more programs ("software"), or some combination of hardware and software. For the purposes of this disclosure reference to "logic" shall mean either hardware, software, or some combination thereof.

Reference in the specification to "one embodiment" or "an embodiment" means that a particular feature, structure, or characteristic described in connection with the embodiment may be included in at least an implementation. The appearances of the phrase "in one embodiment" in various places in the specification may or may not be all referring to the same embodiment.

Also, in the description and claims, the terms "coupled" and "connected," along with their derivatives, may be used. In some embodiments of the invention, "connected" may be used to indicate that two or more elements are in direct physical or electrical contact with each other. "Coupled" may mean that two or more elements are in direct physical or electrical contact. However, "coupled" may also mean that two or more elements may not be in direct contact with each other, but may still cooperate or interact with each other.

Some of the embodiments discussed herein (e.g., with reference to FIGS. 1-6) may provide and/or utilize a dual rake piezo actuator to cool IC devices. In an embodiment, the rake piezo cooling device may use a single piezo patch to generate air movement in two different directions for cooling two heat sources, e.g., including a processor and graphics memory control hub or other IC devices discussed herein, such as the components of the computer system 600 of FIG. 6.

Figure 1:
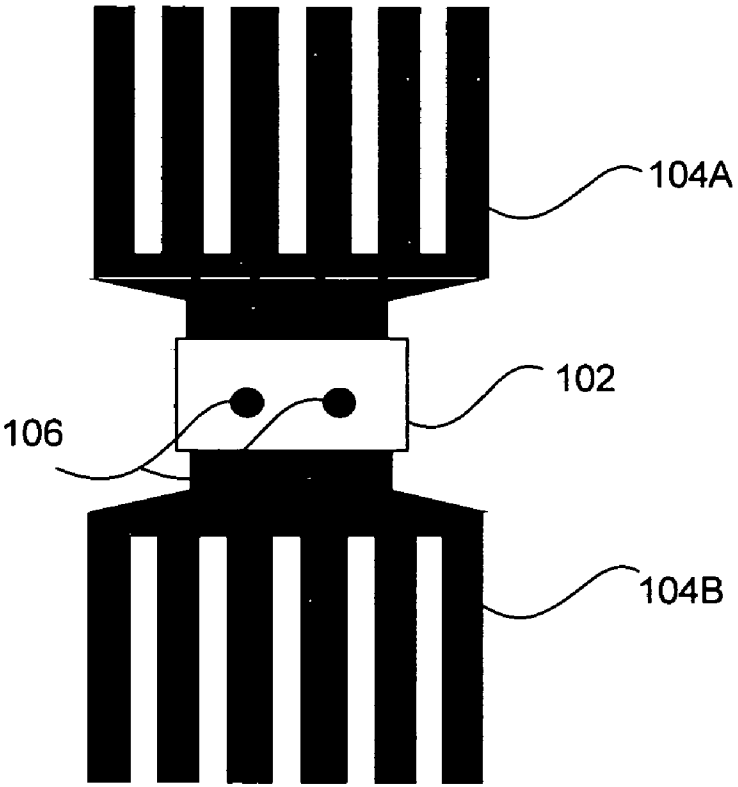
FIG. 1 illustrates a block diagram of a dual rake piezo actuator, according to an embodiment of the invention.

FIG. 1 illustrates a block diagram of a dual rake piezo actuator, according to an embodiment of the invention. A piezo material patch 102 may be coupled to rake blades 104A and 104B. The piezo material patch 102 may be constructed with any type of piezo material, including for example, piezoelectric ceramic material (such as Lead Zirconate Titanate (PZT)) or other types of piezoelectric material (such as polyvinylidene difluoride (PVDF)), which, in some embodiments, may include one or more layers with a thickness of about 20-30 microns. Also, the blades 104A and/or 104B may be constructed with any type of material capable of oscillating, such as for example, Mylar, brass, steel, combinations thereof, etc. Also, the blades 104A and/or 104B may be about 50 to 100 microns thick in some embodiments.

As shown in FIG. 1, the piezo material patch 102 may be coupled at its center to the blades 104A and 104B. However, in some embodiments, e.g., depending on the size of the blades 104A and 104B or the shape of the patch 102, the piezo material patch 102 may be coupled at other locations (e.g., off-center) to the blades 104A and 104B. Accordingly, if the piezo material in the piezo patch 102 (which may be a layered material in an embodiment) is subjected to an alternating electrical current (e.g., through one or more electrical couplings 106), the piezo patch 102 may change its shape resulting in a lateral vibration in the blades 104A and 104B (e.g., at resonance frequency of the blades 104A and 104B). The vibration of the blades may, in turn, generate air flow in two different directions (e.g., each direction corresponding to one of the blades 104A and 104B) which may be used to cool IC devices such as discussed further herein, e.g., with reference to FIGS. 3-5.

Figure 2:
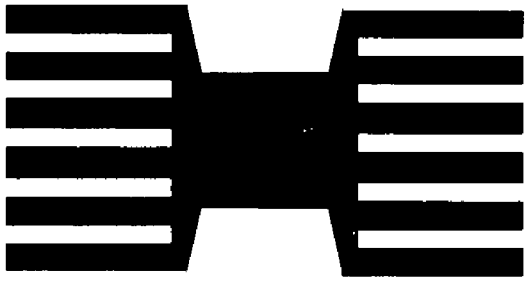
FIG. 2 illustrates an embodiment of the blades shown in FIG. 1.

FIG. 2 illustrates an embodiment of the blades 104A and 104B of FIG. 1. As shown in FIG. 2, blades 104A and 104B may be fabricated as a single component. Fabricating the blades as single component may reduce manufacturing costs and/or ease assembly.

Figure 3:
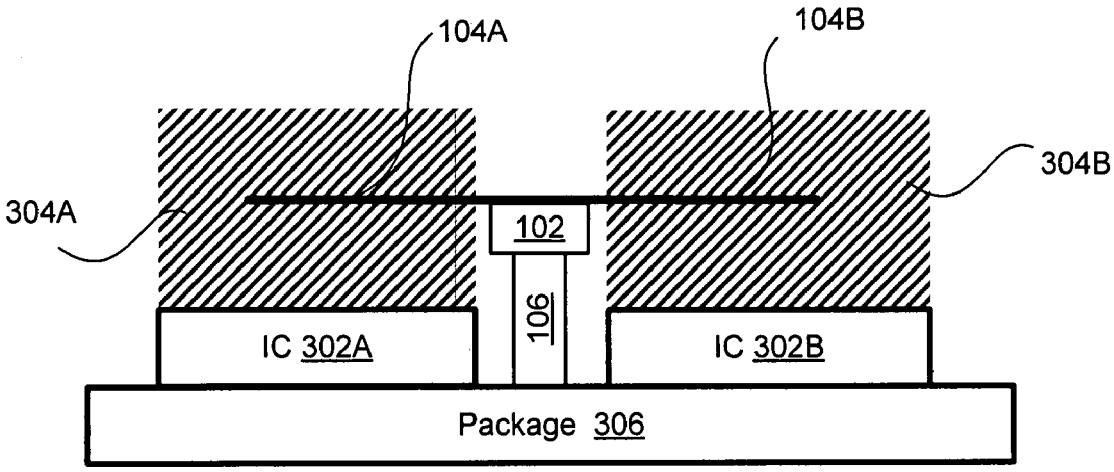
FIGS. 3-4 illustrate block diagrams of integration of a rake piezo actuator with heatsinks, according to some embodiments of the invention.

FIG. 3 illustrates a side view block diagram of integration of a rake piezo actuator with two heatsinks, according to an embodiment of the invention. As shown in FIG. 3, two IC devices 302A and 302B may be coupled to corresponding heatsinks 304A and 304B, respectively. Each of the blades 104A and 104B may be respectively engaged with the heatsinks 304A and 304B. Also, as illustrated in FIG. 3, the piezo patch 102 may be electrically and/or mechanically coupled to a semiconductor package 306 (e.g., through one or more couplings 106). Moreover, even though FIG. 3 illustrates that the patch 102 may be below the blades 104A and 104B, the patch 102 may also be provided above these blades in some embodiments. Furthermore, in an embodiment, the blades 104A and 104B may be coupled between layers of a multilayer patch 102, e.g., where some layers of the patch 102 may be above one or more of the blades 104A and/or 104B, while other layers of the patch 102 may be below one or more of the blades 104A and/or 104B, for example.

Figure 4:
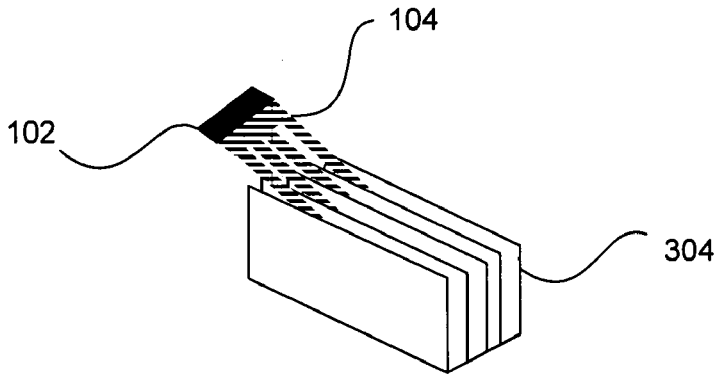

FIG. 4 illustrates a perspective view block diagram of integration of a rake piezo actuator with a heatsink, according to an embodiment of the invention. For simplicity, only one of the blades 104A and 104B of FIGS. 1-3 are shown in FIG. 4. However, as discussed with reference to FIGS. 1-3, more than one blade may be integrated with heatsinks in some embodiments. Furthermore, as shown in FIG. 4, the blade 104 may be coupled to the piezo patch 102. The blade 104 may be in proximity to fins of the heatsink 304, e.g., sufficiently close to fins of the heatsink 304 (for example without touching the fins) to generate air flow around the fins. As the patch 102 changes its shape (such as discussed with reference to FIG. 1) and causes the blade 104 to oscillate, the heat transfer coefficient of the heatsink 304 may be improved.

Figure 5:
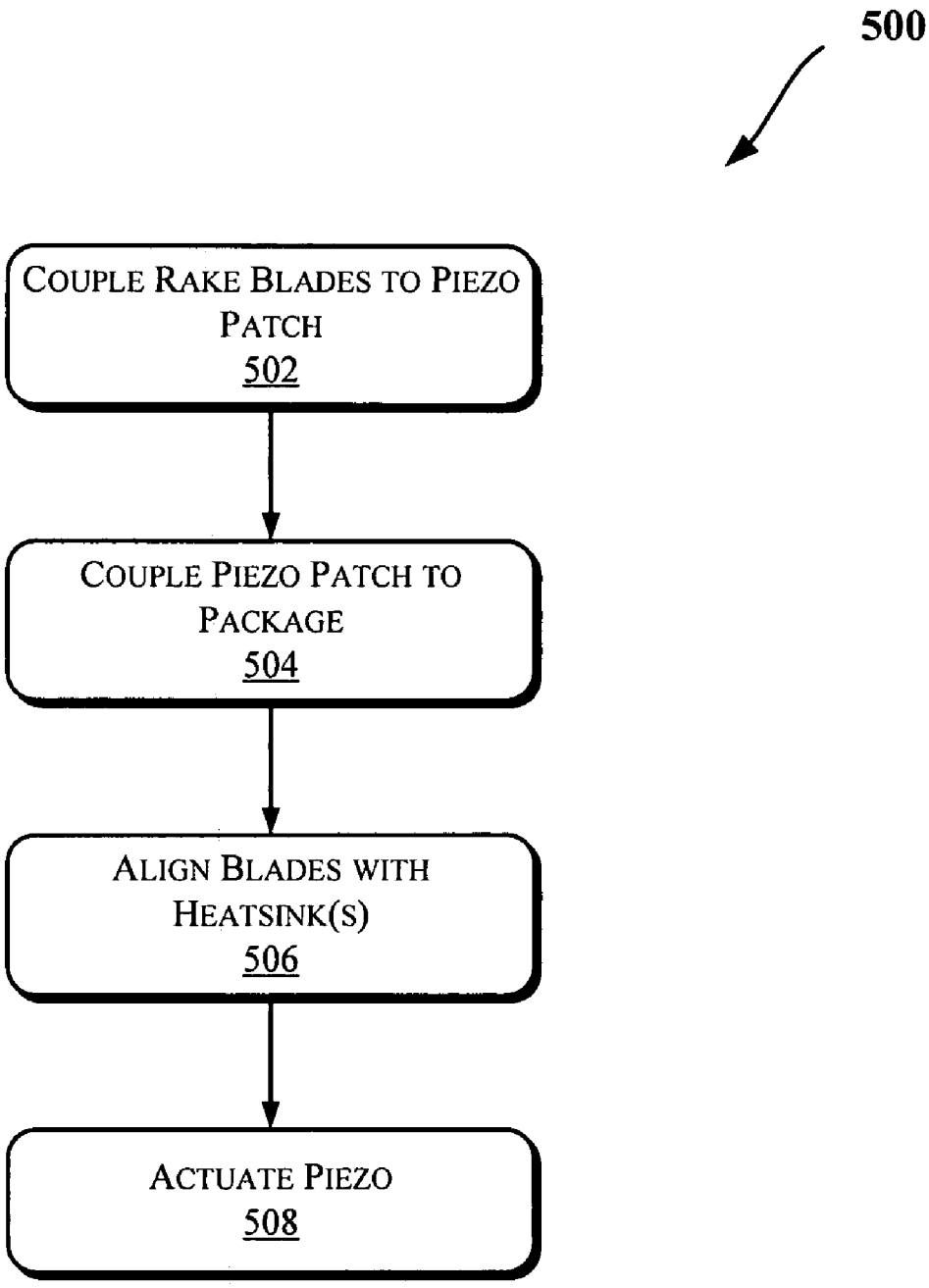
FIG. 5 illustrates a block diagram of a method according to an embodiment.

FIG. 5 illustrates a block diagram of an embodiment of a method 500 to utilize a dual direction rake piezo actuator. In an embodiment, various components discussed with reference to FIGS. 1-4 and 6 may be utilized to perform one or more of the operations discussed with reference to FIG. 5.

Referring to FIGS. 1-5, at an operation 502, one or more rake blades may be coupled to a piezo patch. In an embodiment, blades 104A and/or 104B may be mechanically coupled to the piezo patch 102, e.g., via the couplings 106 and/or other coupling techniques such as glue (e.g., including epoxy), one or more rivets, one or more screws, one or more clamps, etc. At an operation 504, the piezo patch may be coupled to a semiconductor package (e.g., the patch 102 may be electrically coupled to the package 306, for example, through the coupling(s) 106). At an operation 506, the blades may be aligned with corresponding heatsinks (e.g., the blades 104A and/or 104B may be respectively aligned with heatsinks 304A and/or 304B such as discussed with reference to FIGS. 3-4). At an operation 508, the piezo may be actuated.

For example, as discussed with reference to FIGS. 1-4 alternating electrical current may be applied to the patch 102 to cause the piezo patch 102 to change its shape, resulting in a lateral vibration in the blades 104A and/or 104B. In turn, the vibration of the blades may generate air flow through the fins of the heatsinks 304A and/or 304B. In an embodiment, the piezo material patch 102 may be coupled to blades 104A and/or 104B at two ends of piezo material patch 102. The rake piezo may generate air movement in two different directions to allow cooling two different IC devices with a single piezo patch. Furthermore, in an embodiment, the configuration discussed with reference to FIGS. 1-5 may operate at a constant airflow and/or power consumption level with no noise when compared with more traditional axial fans.

In some embodiments, the rake blades may be manufactured as a single component to reduce manufacturing costs. In addition, other costs may be minimized including a reduced need for connectors, power converters, mounting hardware, and/or fan speed control hardware and/or software. Furthermore, a relatively smaller thermal solution size may be provided in some embodiments. In particular, a relatively more compact actuator may be fabricated, in part, because the overall thermal solution length may be reduced when compared with a traditional axial fan. Additionally, some embodiments may provide an improved platform cooling, e.g., through the dual direction air movement improving the heat distribution inside the chassis, in part, because the heated air may be exhausted from the chassis in multiple directions.

Figure 6:
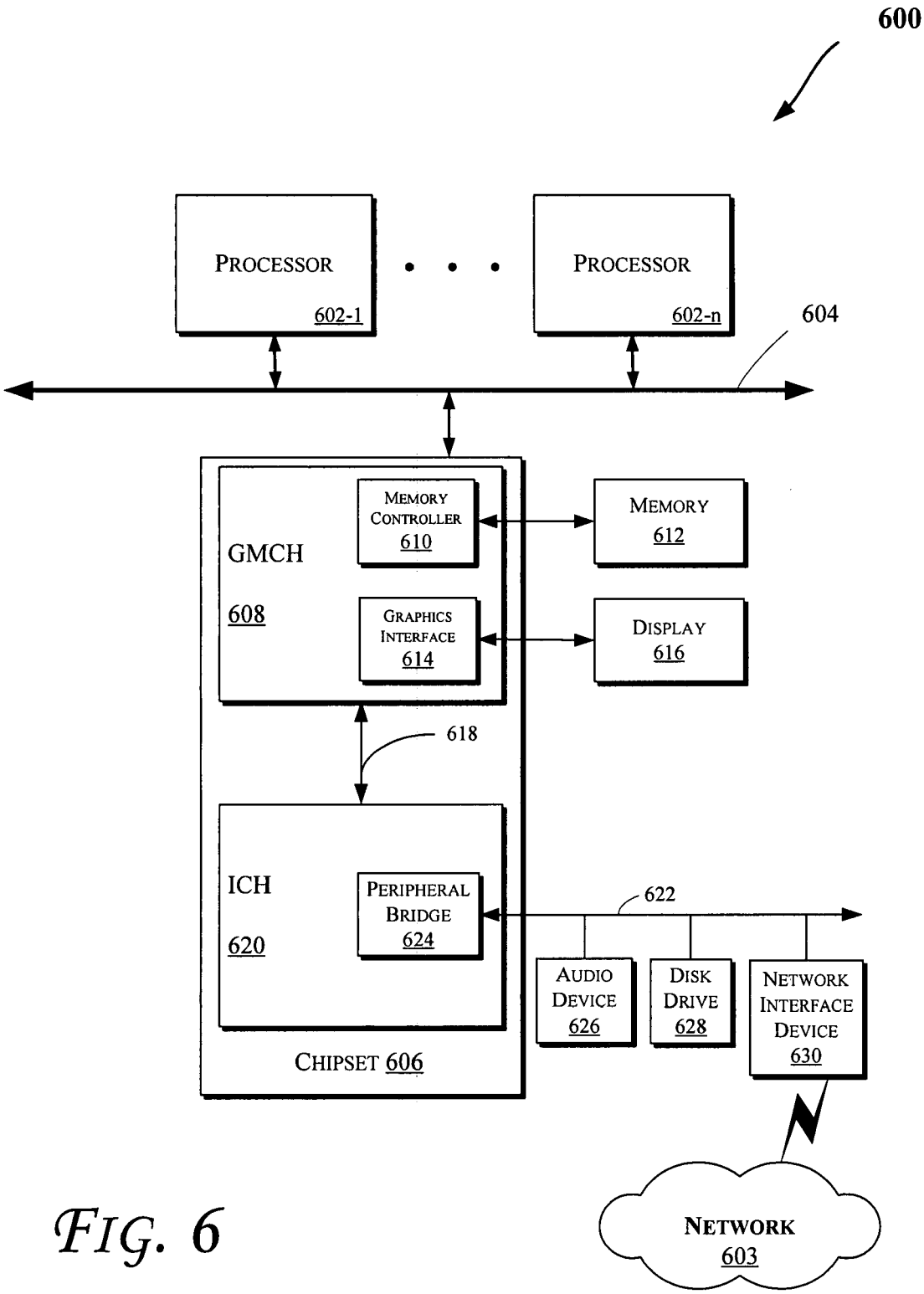
FIG. 6 illustrates a block diagram of a computing system, which may be utilized to implement various embodiments discussed herein.

FIG. 6 illustrates a block diagram of a computing system 600 in accordance with an embodiment of the invention. In an embodiment, various IC components of the system. 600 may be cooled in accordance with one or more of the embodiments discussed herein, e.g., as discussed with reference to FIGS. 1-5. The computing system 600 may include one or more central processing unit(s) (CPUs) 602 or processors that communicate via an interconnection network (or bus) 604. The processors 602 may include a general purpose processor, a network processor (that processes data communicated over a computer network 603), or other types of a processor (including a reduced instruction set computer (RISC) processor or a complex instruction set computer (CISC)). Moreover, the processors 602 may have a single or multiple core design. The processors 602 with a multiple core design may integrate different types of processor cores on the same integrated circuit (IC) die. Also, the processors 602 with a multiple core design may be implemented as symmetrical or asymmetrical multiprocessors. Moreover, the operations discussed with reference to FIGS. 1-5 may be performed by one or more components of the system 600.

A chipset 606 may also communicate with the interconnection network 604. The chipset 606 may include a graphics memory control hub (GMCH) 608. The GMCH 608 may include a memory controller 610 that communicates with a memory 612. The memory 612 may store data, including sequences of instructions that are executed by the CPU 602, or any other device included in the computing system 600. In one embodiment of the invention, the memory 612 may include one or more volatile storage (or memory) devices such as random access memory (RAM), dynamic RAM (DRAM), synchronous DRAM (SDRAM), static RAM (SRAM), or other types of storage devices. Nonvolatile memory may also be utilized such as a hard disk. Additional devices may communicate via the interconnection network 604, such as multiple CPUs and/or multiple system memories.

The GMCH 608 may also include a graphics interface 614 that communicates with a display 616. In one embodiment of the invention, the graphics interface 614 may communicate with the display 616 via an accelerated graphics port (AGP). In an embodiment of the invention, the display 616 may be a flat panel display that communicates with the graphics interface 614 through, for example, a signal converter that translates a digital representation of an image stored in a storage device such as video memory or system memory into display signals that are interpreted and displayed by the display 616. The display signals produced by the interface 614 may pass through various control devices before being interpreted by and subsequently displayed on the display 616.

A hub interface 618 may allow the GMCH 608 and an input/output control hub (ICH) 620 to communicate. The ICH 620 may provide an interface to I/O devices that communicate with the computing system 600. The ICH 620 may communicate with a bus 622 through a peripheral bridge (or controller) 624, such as a peripheral component interconnect (PCI) bridge, a universal serial bus (USB) controller, or other types of peripheral bridges or controllers. The bridge 624 may provide a data path between the CPU 602 and peripheral devices. Other types of topologies may be utilized. Also, multiple buses may communicate with the ICH 620, e.g., through multiple bridges or controllers. Moreover, other peripherals in communication with the ICH 620 may include, in various embodiments of the invention, integrated drive electronics (IDE) or small computer system interface (SCSI) hard drive(s), USB port(s), a keyboard, a mouse, parallel port(s), serial port(s), floppy disk drive(s), digital output support (e.g., digital video interface (DVI)), or other devices.

The bus 622 may communicate with an audio device 626, one or more disk drive(s) 628, and a network interface device 630 (which is in communication with the computer network 603). Other devices may communicate via the bus 622. Also, various components (such as the network interface device 630) may communicate with the GMCH 608 in some embodiments of the invention. In addition, the processor 602 and the GMCH 608 may be combined to form a single chip.

Furthermore, the graphics interface 614 may be included within the GMCH 608 in other embodiments of the invention.

Furthermore, the computing system 600 may include volatile and/or nonvolatile memory (or storage). For example, nonvolatile memory may include one or more of the following: read-only memory (ROM), programmable ROM (PROM), erasable PROM (EPROM), electrically EPROM (EEPROM), a disk drive (e.g., 628), a floppy disk, a compact disk ROM (CD-ROM), a digital versatile disk (DVD), flash memory, a magneto-optical disk, or other types of nonvolatile machine-readable media that are capable of storing electronic data (e.g., including instructions). In an embodiment, one or more of the components of the system 600 may be arranged in a point-to-point (PtP) configuration. For example, processors, memory, and/or input/output devices may be interconnected by a number of point-to-point interfaces.

In various embodiments of the invention, the operations discussed herein, e.g., with reference to FIGS. 1-6, may be implemented as hardware (e.g., logic circuitry), software, firmware, or combinations thereof, which may be provided as a computer program product, e.g., including a machine-readable or computer-readable medium having stored thereon instructions (or software procedures) used to program a computer to perform a process discussed herein. The machine-readable medium may include a storage device such as those discussed with respect to FIG. 6.

Additionally, such computer-readable media may be downloaded as a computer program product, wherein the program may be transferred from a remote computer (e.g., a server) to a requesting computer (e.g., a client) by way of data signals embodied in a carrier wave or other propagation medium via a communication link (e.g., a bus, a modem, or a network connection). Accordingly, herein, a carrier wave shall be regarded as comprising a machine-readable medium.

Thus, although embodiments of the invention have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. An apparatus comprising:

a plurality of blades; and a piezo patch coupled to the plurality of blades, wherein the piezo patch causes the plurality of blades to oscillate in response to an alternating current and wherein the plurality of blades have a rake shape to allow the blades to be inserted between fins of a heatsink.

2. The apparatus of claim 1, wherein a first portion of the plurality of blades is coupled to a first side of the piezo patch and a second portion of the plurality of blades is coupled to a second side of the piezo patch.

3. The apparatus of claim 2, wherein the first side and the second side of the piezo patch are directly opposing sides.

4. The apparatus of claim 1, wherein at least one of the plurality of blades is to be extended: (a) in a plane parallel to a base of the heat sink and (b) between at least two fins of the heat sink, wherein the at least two fins of the heatsink are to protrude in a plane that is perpendicular to the based of the heatsink.

5. The apparatus of claim 1, wherein the alternating current causes the blades to oscillate to generate and air flow between the fins of the heatsink.

6. The apparatus of claim 1, wherein the plurality of blades are on at least two different sides of the piezo patch.

7. The apparatus of claim 6, wherein an oscillation of the plurality of blades generates an air flow between fins of at least two heatsinks.

8. The apparatus of claim 1, further comprising a first heatsink coupled to a processor and a second heatsink coupled to a chipset, wherein an oscillation of the plurality of blades generates an air flow between fins of the first and second heatsinks to cool the processor and the chipset.

9. The apparatus of claim 8, wherein the processor comprises a plurality of cores.

10. The apparatus of claim 1, wherein, in response to the alternating current, the piezo patch is to change its shape to cause lateral vibration in the plurality of blades.

11. A method comprising:

coupling a plurality of blades to two opposing sides of a piezo patch; and coupling the piezo patch to a semiconductor package, wherein the plurality of blades have a rake shape to allow the blades to be inserted between fins of a heatsink.

12. The method of claim 11, further comprising the piezo patch changing its shape in response to an alternating current.

13. The method of claim 12, further comprising oscillating the plurality of blades in response to the changing shape of the piezo material.

14. The method of claim 11, further comprising electrically coupling the piezo patch to the semiconductor package.

15. The method of claim 11, further comprising aligning the plurality of blades with one or more heatsinks.

16. The method of claim 15, further comprising coupling the one or more heatsinks to one or more integrated circuit devices.

17. The method of claim 11, further comprising extending at least one of the plurality of blades: (a) in a plane parallel to a base of the heat sink and (b) between at least two fins of the heat sink, wherein the at least two fins of the heatsink are to protrude in a plane that is perpendicular to the based of the heatsink.

* * * * *